US006341776B1

(12) United States Patent
Whitten

(10) Patent No.: US 6,341,776 B1
(45) Date of Patent: Jan. 29, 2002

(54) PRODUCT DELIVERY APPARATUS HAVING A PRODUCT TRANSPORT RECEIVING AREA

(75) Inventor: David Elliot Whitten, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 08/637,855

(22) Filed: Apr. 25, 1996

(51) Int. Cl.[7] ..... B65H 29/00
(52) U.S. Cl. ..... 271/187; 271/315
(58) Field of Search ..... 271/315, 187, 271/178, 302, 287

(56) References Cited

U.S. PATENT DOCUMENTS

| | | | | |
|---|---|---|---|---|
| 3,162,439 A | * | 12/1964 | Poland et al. | 271/187 |
| 4,024,793 A | * | 5/1977 | Larrison et al. | 89/135 |
| 4,357,008 A | | 11/1982 | Campbell | 271/315 |
| 4,925,179 A | | 5/1990 | Breton et al. | 271/187 |
| 5,083,768 A | | 1/1992 | Ertavi et al. | 271/182 |
| 5,112,033 A | | 5/1992 | Breton | 270/47 |
| 5,180,160 A | | 1/1993 | Belanger et al. | 271/315 |
| 5,374,946 A | * | 12/1994 | Shirakawa | 428/908.8 X |
| 5,639,083 A | * | 6/1997 | Doucet | 271/315 |

* cited by examiner

*Primary Examiner*—David H. Bollinger
(74) *Attorney, Agent, or Firm*—Davidson, Davidson & Kappel, LLC

(57) ABSTRACT

The present invention is directed to providing a product delivery apparatus which includes a fan wheel or the like having a modified arrangement for interacting with a product feed device, to enhance the control with which products are delivered into the pockets of the fan wheel. In accordance with exemplary embodiments, characteristics of the fan wheel are adjusted with regard to the product feed to accommodate product delivery requirements. More particularly, exemplary embodiments are directed to modifying a fan wheel to include a receiving area in each fan tip for receiving a product feed device (e.g., conveyor belt, tape drive, roller and so forth), such that the product feed devices can be placed in alignment with the fan blades of the fan wheel. Such a feature provides better control of the products as they are transported into the fan blades, since the product feed can be placed in closer proximity to a fan arrangement along the direction of product transport. Further, such a feature allows for the use of wider fan tips, which can produce increased frictional surface contact with products being received from the product feed, and thereby reduce the possibility of product crashing within the fan pockets. Exemplary embodiments can therefore achieve enhanced product control without increasing the number of tape drives and/or delivery fans.

8 Claims, 5 Drawing Sheets

1
2
3
4
5
6
7
8
9
10
11
12
13
14
15

18
7
16
7
20
21
21
17
17
22
20
14
14
14a
14b
14c
14d

PRODUCT DELIVERY APPARATUS HAVING A PRODUCT TRANSPORT RECEIVING AREA

BACKGROUND OF THE INVENTION

1. Field of the Invention

The present invention relates to a product delivery apparatus, such as a fan wheel or the like of a printing press, which includes a modified arrangement for interacting with a product feed, or transport.

2. State of the Art

The use of delivery fans for receiving products, such as signatures from a printing press, is known. Such delivery fans are typically located between a folder and a press delivery conveyor, the delivery fan including a plurality of fan blades for forming pockets that receive signatures from the folder as the delivery fan is rotated about its axis. A product feed which includes, for example, conveyor belts, transport tapes and/or rollers is typically used to transport the product from the folder to the delivery fan or fans.

For example, U.S. Pat. No. 4,925,179 discloses a delivery fan with undulated fan pockets. The fan includes two sets of blades. The blades of one set are equally spaced apart axially and define one side of each pocket. The blades of the other set are equally spaced apart axially and define the other side of each pocket. The blades of the two sets have surfaces for engaging opposite sides of a signature and for deforming the signature into undulations extending in a direction transverse to the transport direction of the signature. Due to frictional contact between the signature and the surfaces of the pocket, the signature is slowed down to minimize buckling or bouncing of the signature in the respective pocket.

Further, U.S. Pat. No. 5,112,033 discloses a folder apparatus for a web-fed printing press. There are two fan arrangements, each having a plurality of mutually adjacent fans spaced apart from one another on a common axis, the common axes for each of the two fan arrangements being disposed parallel to one another. Each of the fans in one of the two fan arrangements is disposed adjacent to and in a respective common plane with a respective one of the fans in the other of the two fan arrangements. Each fan includes fan blades having tips located about the fan's periphery, the fan blade tips being located in a common plane with the fan blade tips of a respective fan in the other fan arrangement. The circumferences of the two fan arrangements, as defined by the respective fan blade tips, are configured to intersect one another. A device is provided on the fan arrangements for preventing a collision of the respective fan blade tips.

Although delivery fans are thus known for engaging and forming a product which has been received from a product feed (e.g., conveyor belts or transport tapes), currently available delivery fans are configured with the product feed interlaced between the mutually adjacent fan blades which have been spaced apart from one another along a common axis. For example, the transport tapes described in the aforementioned U.S. Pat. No. 5,112,033 are located between the mutually adjacent fan blades in each of the two fan arrangements, with the fan blades and the transport tapes being staggered along a direction parallel to the axes of the two fan arrangements. However, such a configuration results in significant drawbacks. For example, such a configuration results in problems with book marking. Further, due to a lack of frictional contact and product control, the bottom of signatures which are transported from the product feed (i.e., the transport tapes) typically crash into the bottom of the fan pockets, thereby damaging the signatures.

It would therefore be desirable to provide a product delivery apparatus which includes, for example, a fan wheel and associated product feed, and which provides for better control during transport of products into the delivery fan pockets without merely increasing the number of mutually adjacent fans in each fan arrangement.

SUMMARY OF THE INVENTION

Exemplary embodiments of the present invention are directed to providing a product delivery apparatus which includes a fan wheel or the like having a modified arrangement for interacting with a product feed device, to enhance the control with which products are delivered into the pockets of the fan wheel. In accordance with exemplary embodiments, characteristics of the fan wheel are adjusted with regard to the product feed to accommodate product delivery requirements. More particularly, exemplary embodiments are directed to modifying a fan wheel to include a receiving area in each fan tip for receiving a product feed device (e.g., conveyor belt, tape drive, roller and so forth), such that the product feed devices can be placed in alignment with the fan blades of the fan wheel. Such a feature provides better control of the products as they are transported into the fan blades, since the product feed can be placed in closer proximity to a fan arrangement along the direction of product transport. Further, such a feature allows for the use of wider fan tips which can produce increased frictional surface contact with products being received from the product feed, and thereby reduce the possibility of product crashing within the fan pockets. Exemplary embodiments can therefore achieve enhanced product control without increasing the number of tape drives and/or delivery fans.

In accordance with alternate exemplary embodiments of the present invention, the modified fan blades can include replaceable fan blade tips having receiving areas as described above, such that the fan blade tips can be readily substituted to, for example, accommodate different product feeds and/or product characteristics. Where the split tip fan blades are formed as replaceable fan blade tips, an easy exchange of parts of the fan wheels is feasible without dismounting the fan wheel arrangement in its entirety. The solution allows for retrofitting of fan tips with fan blade tips having a different curvature, a different material and/or a different size receiving area. Damaged fan tips due to wear can also be easily exchanged. Furthermore, by mounting fan blade tips of different material, a rebalancing of fan wheel arrangements can easily be achieved.

Generally speaking, exemplary embodiments of a product delivery apparatus according to the invention include:

- at least one fan wheel which is rotatably mounted;
- a plurality of fan blades included on said at least one fan wheel; and
- a receiving area included within each of said fan blades for receiving a product feed used to transport a product into pockets of said fan blades.

BRIEF DESCRIPTION OF THE DRAWINGS

Exemplary embodiments and methods of operation of the invention, together with additional objects and advantages thereof, will be best understood from the following description of exemplary embodiments when read in connection with the accompanying drawings wherein.

DETAILED DESCRIPTION OF PREFERRED EMBODIMENTS

Figure 1:
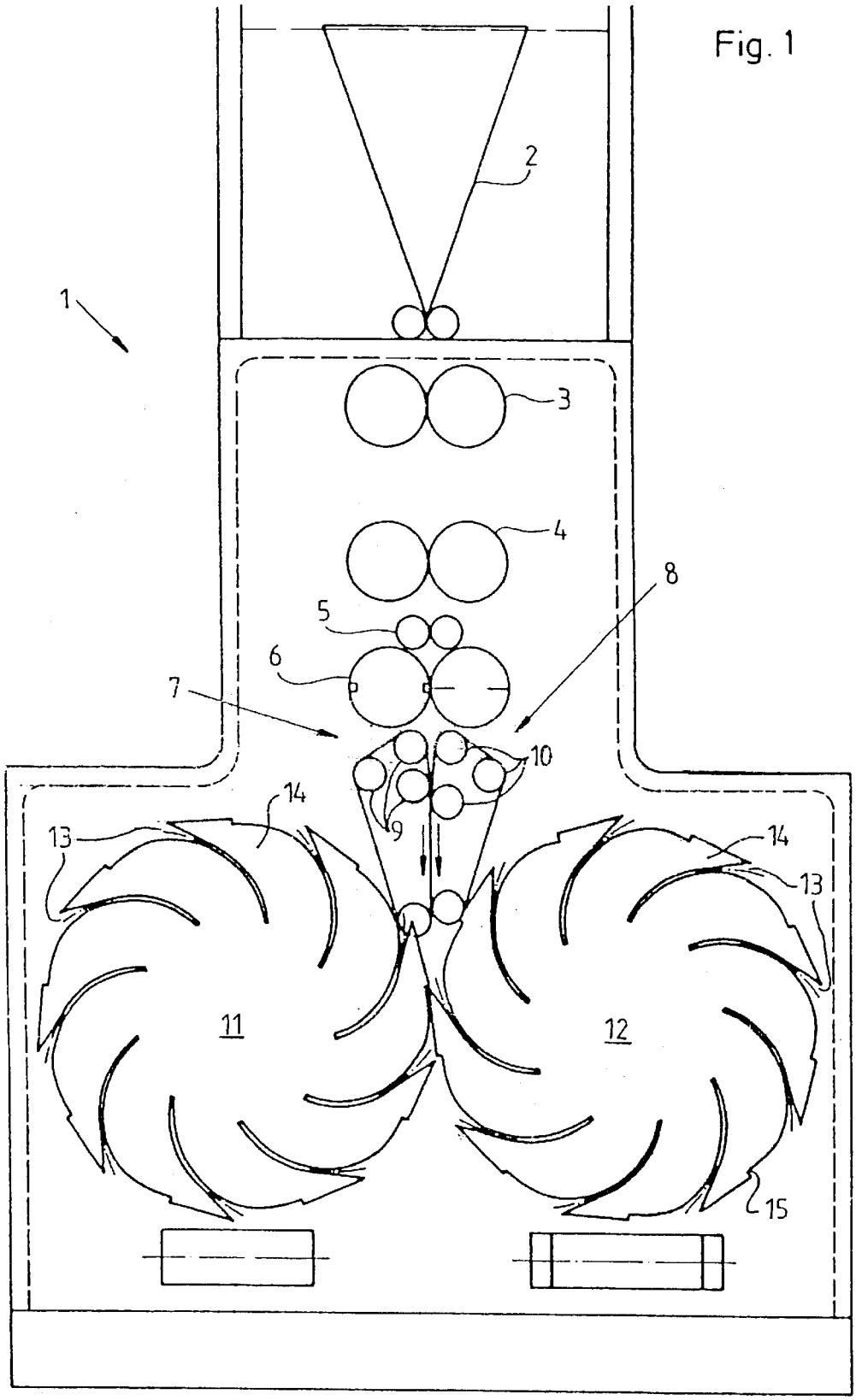
FIG. 1 shows a schematic view of a folder having two fans partially overlapping each other's circumferential envelope curve, the fans being configured in accordance with an exemplary embodiment of the present invention.

FIG. 1 shows a schematic view of an exemplary embodiment of product delivery device, represented as a folder having two partially overlapping fan arrangements for transporting material. Each of the overlapping fan arrangements can include any number of mutually adjacent fans spaced apart from one another on a common axis in a manner as described in U.S. Pat. No. 5,112,033, entitled "Folder Apparatus For A Web-Fed Printing Press", the disclosure of which is hereby incorporated by reference in its entirety.

A folder 1 includes a former 2 for leading a material, such as longitudinally folded continuous web of material, into upper draw rollers 3. After passing the upper draw rollers 3, the web enters lower draw rollers 4 and is subsequently conveyed via guide rollers 5 to a cutting cylinder 6 which severs samples (e.g., products or signatures) from the continuous web of material. The samples are conveyed by a product feed into fan-pockets 13 of at least one delivery fan which is similar to that described in the aforementioned U.S. Pat. No. 5,112,033, but which has been modified in accordance with an exemplary embodiment of the present invention. The product feed is represented in FIG. 1 as including at least one product feed device, such as the left lead-in (e.g., high speed) tape 7 and the right lead-in (e.g., high speed) tape 8.

In the exemplary FIG. 1 embodiment, fans 11, 12 from each of two respective fan arrangements located on parallel axes are illustrated. However, those skilled in the art will appreciate that a plurality of fans can be located on each of the parallel axes, as mentioned previously. The circumferences of the fans 11, 12 constitute envelope curves which partially overlap each other. Thus, single samples are alternately led into every other one of the fan pockets 13 of the fans 11, 12. Each fan pocket 13 is formed between adjacent fan blades 14 of the fans 11, 12. Below the fans 11, 12, a conveying means, such as any known sample conveyor, is assigned to each of the fans for delivering the samples to further post press equipment.

In accordance with exemplary embodiments, the delivery fans of FIG. 1 are modified to include a receiving area within each of the fan blade tips. The receiving area of each fan blade tip is configured to receive a product feed device in alignment with the fan blade tips. As those skilled in the art will appreciate, the receiving area can be formed by configuring each of the fan blade tips as a split tip, a width of the receiving area between the split tips of each fan blade being sized to accommodate the product feed (e.g., transport tape, conveyor belt and so forth) associated with the delivery fans. The overall width of each split fan blade tip can also be varied to accommodate desired processing of a particular product. That is, the overall surface area of the tips used to define the receiving area for each fan blade can be sized to adjust the frictional contact of the fan blades with a product to be transported into the delivery fans.

In an exemplary embodiment, each receiving area is formed by two split tips of each respective fan blade. However, those skilled in the art will appreciate that the receiving area defined within each fan blade tip can be configured in any manner readily apparent to those skilled in the art. For example, each fan blade can include a single tip which is modified into an "L" configuration to accommodate a placement of the product feed in parallel with the fan blade. Alternately, more than two split tips can be configured at the end of each fan blade to accommodate multiple conveyor belts or transport tapes of the product feed. Such a configuration permits the multiple, mutually adjacent delivery fans of each fan arrangement to be formed as a unitary structure, with the receiving areas being defined as a plurality of mutually adjacent grooves located about the periphery of the fan arrangement.

Figure 2:
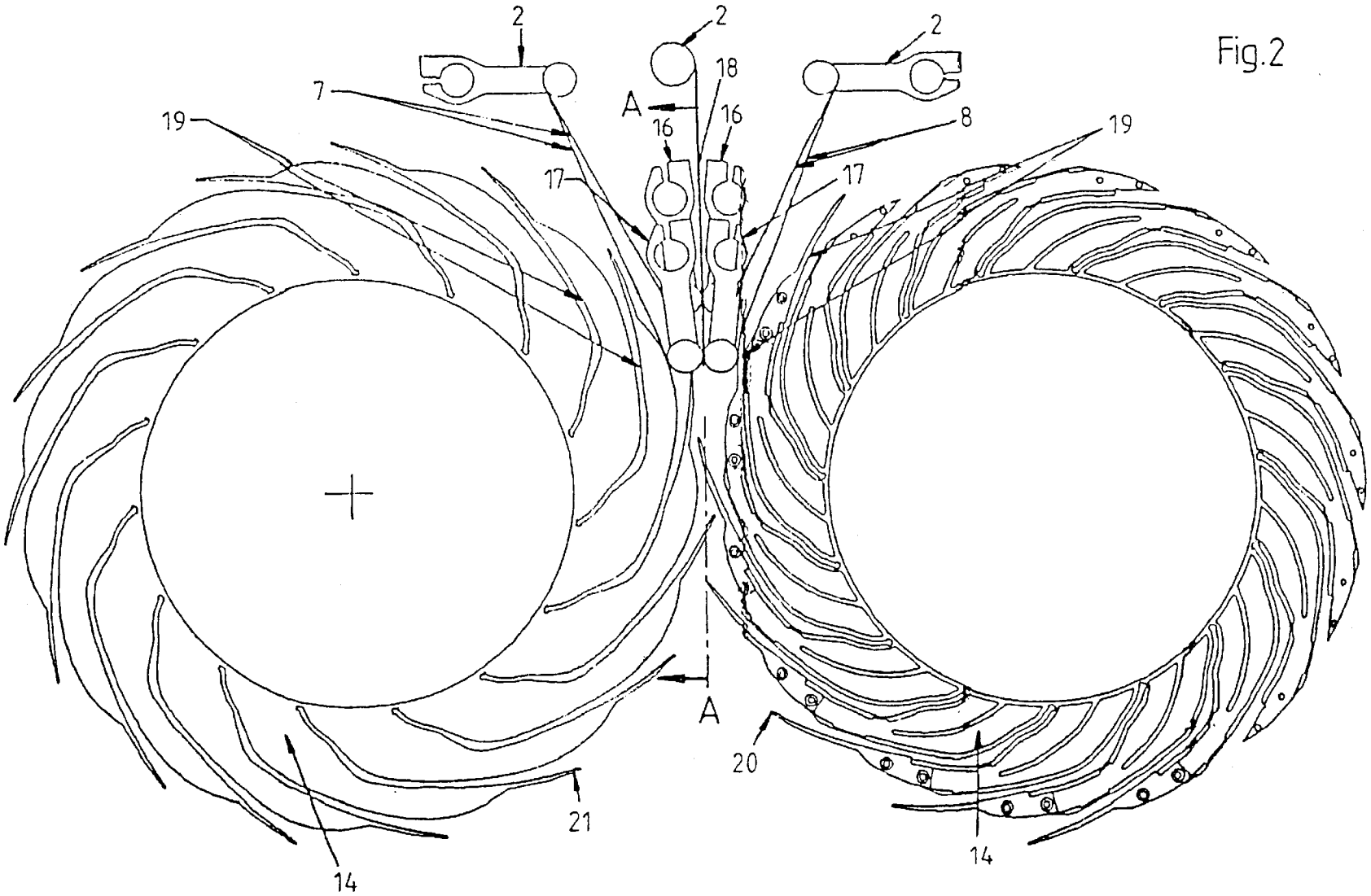
FIG. 2 shows, in a greater detail, an exemplary embodiment of overlapping delivery fans of the two parallel fan arrangements of FIG. 1.

FIG. 2 illustrates the transport tapes 7, 8 of the exemplary FIG. 1 product feed in greater detail, along with the orientation of the product feed along the transport path relative to the delivery fans. Because the receiving areas are formed in the fan blade tips, the product feed devices (i.e., transport tapes 7, 8) can be placed in closer proximity to the delivery fans along the transport direction of products into the delivery fans.

In FIG. 2, the transport tapes are mounted to arms 16, 17 for transporting products 18 into alternating fan pockets 19 defined by the fan blades. The lower arms 17 are located in the receiving area between split tips 20 and 21 of the delivery fans 14 associated with each of the two fan arrangements shown. The delivery fan 14 shown to the left hand side of FIG. 2, for purposes of illustration, includes split fan tips which are configured as part of the delivery fan itself (that is, the delivery fan blades and fan blade tips are configured as a unitary structure). In contrast, for purposes of illustration, an alternate embodiment of the invention is represented by the delivery fan 14 shown to the right hand side of FIG. 2, this delivery fan being configured with removable fan blade tips 20 (that is, fan blade tips which can be removed from the fan blades). The removable tips 20 can be attached and detached from the delivery fan in a manner similar to that described in co-pending U.S. application Ser. No. 08/429,155 filed Apr. 26, 1995 and entitled "Product Delivery Apparatus Having Replaceable Elements", the disclosure of which is hereby incorporated by reference in its entirety. The removable tips 20, as will be described with respect to FIG. 4, can be formed as a unitary split tip component, or can be configured with multiple split tip components that are separately attachable to a respective fan blade of the delivery fan 14.

The delivery fan and/or replaceable fan tips can be made of any material including, but not limited to, plastic (e.g., injection molded plastic, structural foamed plastic and/or machined solid plastic), metal (e.g., aluminum, steel and so forth) or composites (e.g., carbon fiber). The materials used to form the delivery fan or fan blade tips can also be coated or plated with other materials to fulfill determining factors in tip material selection such as strength, friction characteristics, manufacturing method and tip configuration. The delivery fan and/or fan tips can be cast, molded, machined, forged or produced using any available forming process. For example, where the replaceable fan blade tips are made from metal, they can be machined from solid stock, formed and welded from individual pieces, cast, molded, or formed using any other conventional technique. Those skilled in the art will appreciate that the foregoing materials and techniques are by way of example only, and that any known material processed in any known way can be used to form the replaceable fan blade tips. By configuring the delivery fans and/or fan blade tips of different materials, a balancing of the fan wheels 14 can be achieved.

Figure 3:
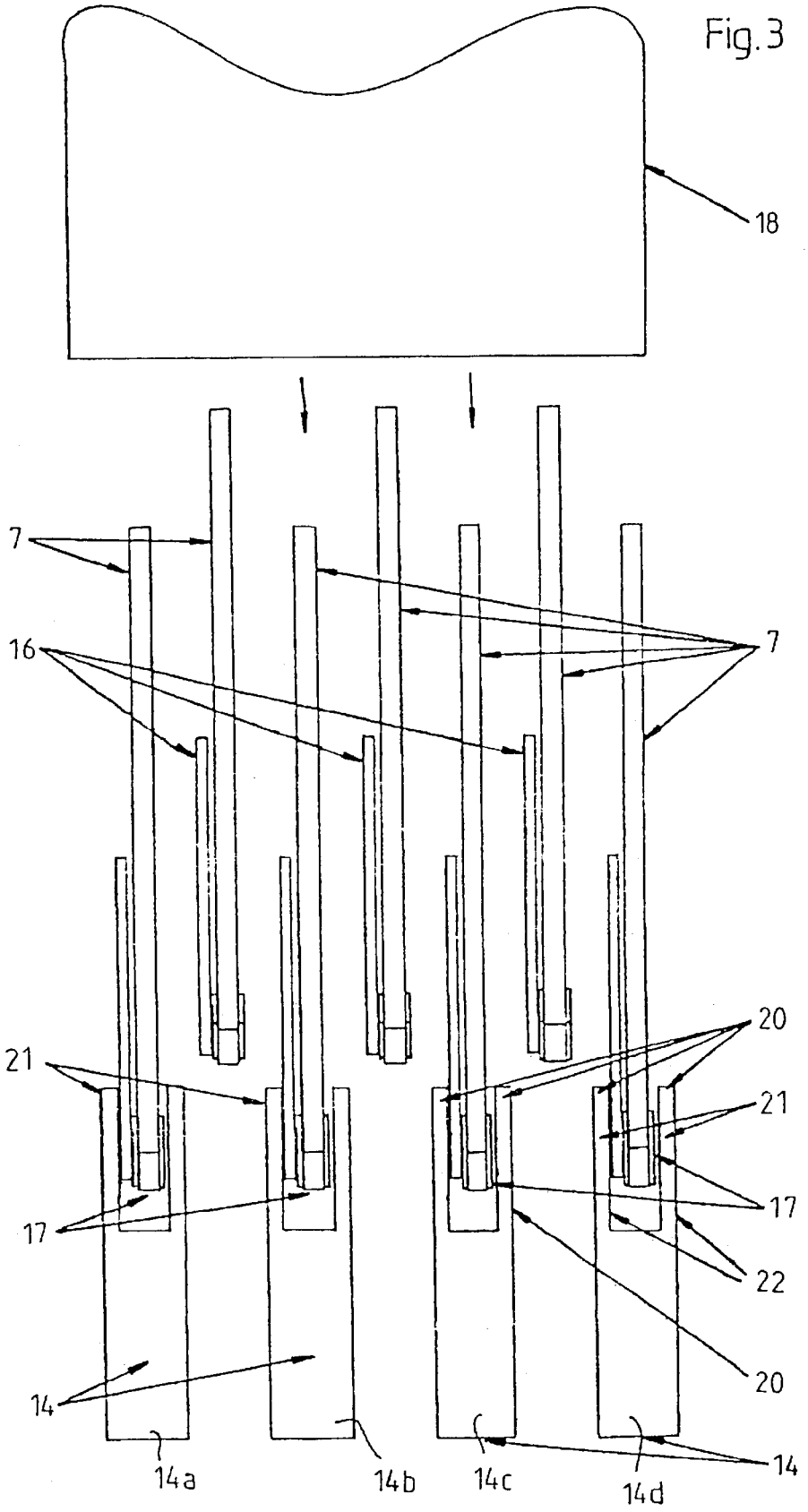
FIG. 3 shows a cross-sectional view of the fan blade tips of mutually adjacent fans from one of the two fan arrangements in FIGS. 1 and 2, along with an associated product feed.

FIG. 3 illustrates a cross-sectional view of the mutually adjacent delivery fans for one of the two overlapping fan arrangements shown along sectional lines A—A in FIG. 1, in combination with an associated product feed. As illustrated in FIG. 3, it can be seen that the transport tapes 7 and 8 of the product feed are accommodated within a receiving area located between the edges of each split-tip 21 in the fan blades of the mutually adjacent delivery fans. In the exemplary FIG. 3 embodiment, the first two mutually adjacent delivery fans 14A and 14B are represented as delivery fans wherein the split tips of the fan blades are formed with the delivery fans themselves in a unitary structure. In contrast, the delivery fan 14C of FIG. 3 has been modified to illustrate an alternate embodiment of the present invention wherein the split tip of the fan blades associated with the delivery fan are formed as single component, replaceable tips (i.e., the split tips can be removed from the fan blades). Yet another exemplary embodiment of the present invention is represented by the delivery fan 14D of FIG. 3, wherein each of the split tips associated with a given delivery fan is configured with multiple components, each of which can be separately removed from the fan blade. That is, rather than forming the split tip as a unitary component having two prongs and a receiving area located therebetween, the split tip of the delivery fan 14D is formed with individual tips 22 which, upon attachment to the delivery fan, form a receiving area therebetween. As represented in FIG. 3, the multiple split tips can be attached to the outer edges of the fan blade in any known fashion, such as via the use of clips, screws, pins or other fastening means. Of course, those skilled in the art will appreciate that any fan arrangement can be configured using the same type of delivery fans, or can be configured using any mix of delivery fans (e.g., some delivery fans can have replaceable fan blade tips, while others do not).

Figure 4:
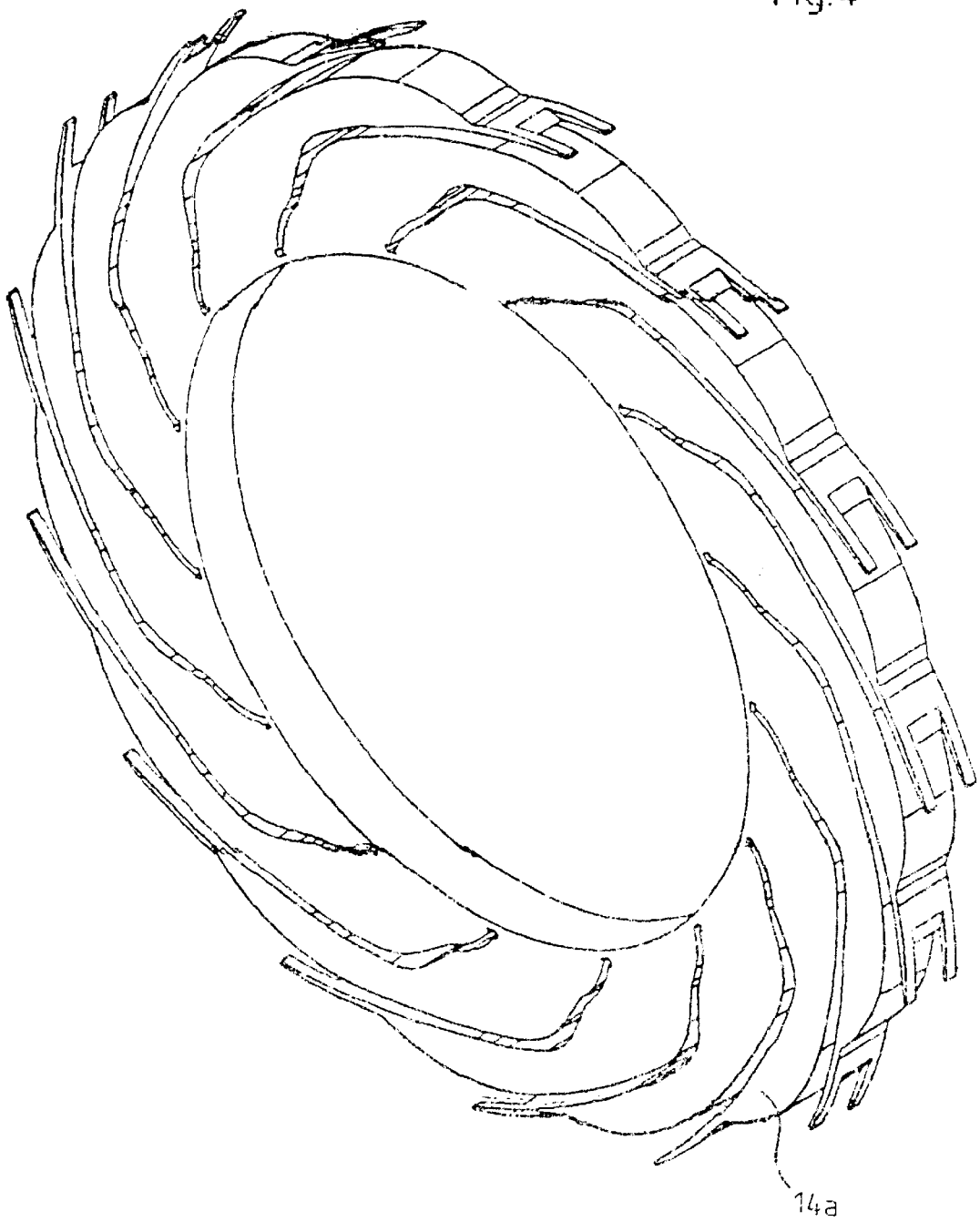
FIG. 4 shows a perspective view of an exemplary delivery fan.

FIG. 4 illustrates a perspective view of an exemplary embodiment of the FIG. 2 delivery fan 14 wherein the delivery fan and fan blade tips are formed as a unitary structure (that is, delivery fan 14A or 14B of FIG. 3). As illustrated in FIG. 4, each of the fan blade tips is formed with a receiving area for accommodating the product feed.

Figure 5:
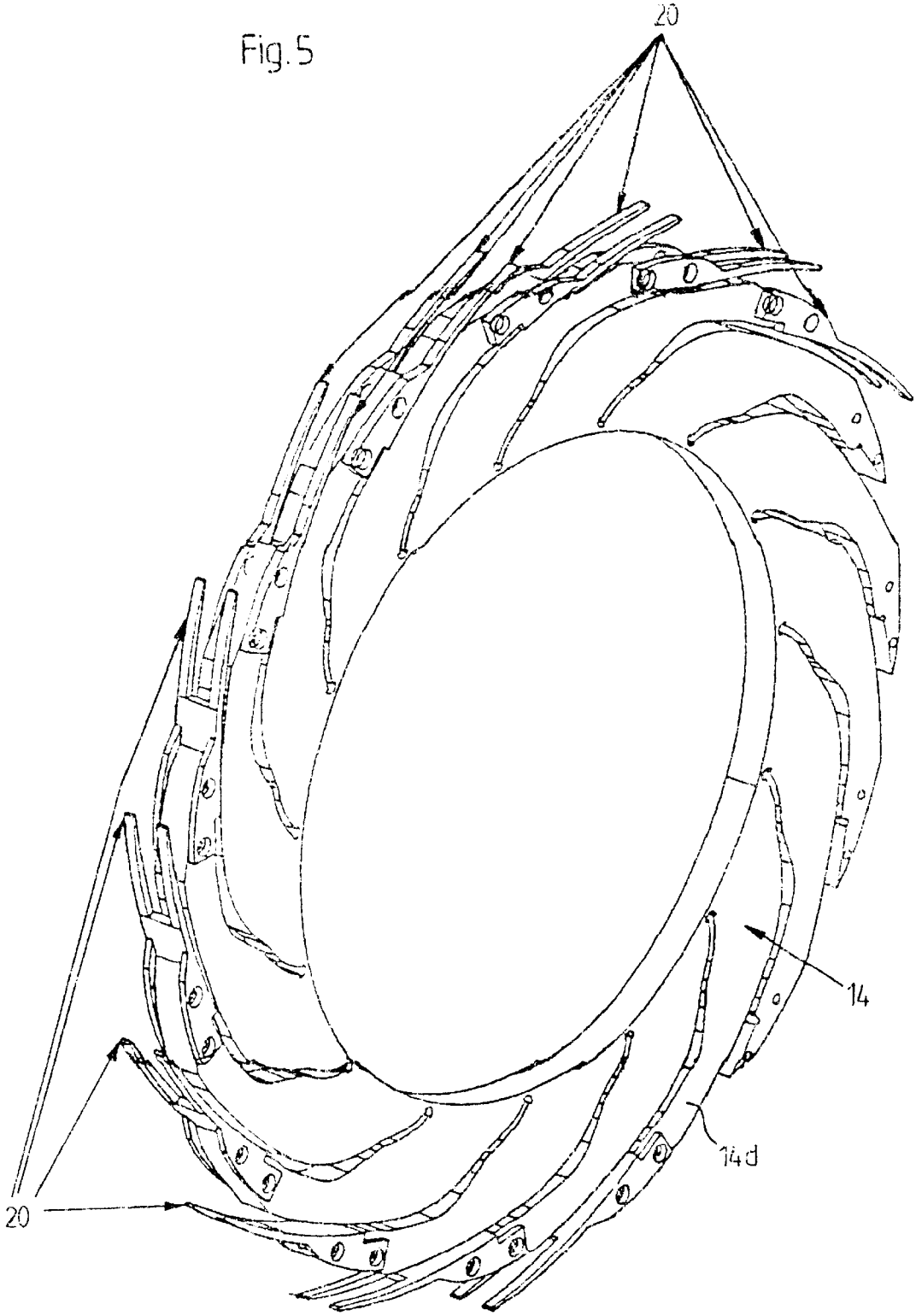
FIG. 5 shows an alternate embodiment of the FIG. 4 delivery fan as reconfigured to include replaceable fan tips.

In an alternate exemplary embodiment represented by the perspective view of FIG. 5, the delivery fan shown to the right hand side of FIG. 2 is represented as including replaceable fan tips (that is, delivery fan 14C or 14D of FIG. 3). As with the exemplary FIG. 4 embodiment, each of the replaceable fan blade tips is formed with a receiving area for accommodating the product feed. As mentioned previously, the replaceable split tip can be formed as a unitary structure (i.e., as described with respect to delivery fan 14C of FIG. 3), such that all prongs of each fan blade tip can be attached or detached from a respective fan blade in one step. Alternately, as was described with respect to the replaceable fan blade tip of the delivery fan 14D in FIG. 3, each of the prongs of the split tip can be separately attached to a respective fan blade. Such an embodiment is also represented in FIG. 5, wherein each of the split tips shown is represented as a multi-component tip, with each component of the split tips being attached to an outer edge of a respective fan blade.

Replaceable fan blade tips formed as unitary structures or as structures comprised of multiple components, can be configured to snap-on to the delivery fan in the manner described in the aforementioned co-pending application. In this respect, a mounting area of the delivery fan can be defined by a plane where the replaceable component (e.g., fan blade tip) contacts the delivery fan. A corresponding mounting area on each separately replaceable component of the fan blade tip can be matched to the mounting area on the delivery fan. A clip as described in accordance with the co-pending application can be included on the replaceable fan blade tip, or on each of the multiple components of the replaceable fan blade tip, for engaging an aperture in the mounting area of a respective fan blade. The aperture can, for example, be formed with any shape, such as a rectangular shape. The fan blade tip and/or fan blade can also include an aligning pin or pins. The aligning pin can be used to engage a bore in the mounting area of each fan blade to align (e.g., center) each fan blade tip component with the fan blade.

Of course, those skilled in the art will appreciate that any number of methods or configurations can be used for attaching the replaceable components of each fan blade tip to the delivery fan. For example, a threaded receptacle can be included in the mounting area of the delivery fan or in the replaceable component. The receptacle can, for example, be an ultrasonic insert which is vibrated into place using ultrasound in known fashion. Alternately, any fastening device, such as a screw or the like, can be used to mount each of the replaceable fan blade tip components to a respective fan blade on the delivery fan. The screw or the like can engage a threaded receptacle provided in the material.

In accordance with yet alternate embodiments of the present invention wherein replaceable split fan blade tip components are used, each fan blade can be configured with an end region having a recess and two abutting surfaces as described in the aforementioned co-pending application. Each of the corresponding split tip fan blade tip components can have abutting surfaces as well, such that each fan blade tip component fits to a respective fan blade of the delivery fan. Each abutting surface of the fan blade tip can, for example, be configured as a cam for engaging a matched recess of the fan blade. Thus, the fan blade and fan blade tip component contact along a contacting plane with the abutting surfaces, thereby maintaining a final position of the fan blade tip component on the fan blade.

The shape and the orientation of said abutting surfaces prevent the fan blade tips from being mounted in a wrong orientation with regard to the sense of rotation of the fan wheel. Of course, the fan blade tips and associated delivery fans can be configured for rotation in either direction.

It will be appreciated by those of ordinary skill in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. Device for product delivery comprising:

at least one fan wheel which is rotatably mounted;

a plurality of fan blades included on said at least one fan wheel; and a receiving area included within each of said fan blades for receiving a product feed used to transport a product into pockets of said fan blades, each of said plurality of fan blades including a fan blade tip;

said receiving area being configured within said fan blade tip and being defined between two prongs of said fan blade tip.

2. Device according to claim 1, wherein said at least one fan wheel, said plurality of fan blades and said fan blade tips are formed as a unitary structure.

3. Device according to claim 1, wherein said fan blade tip is formed as a unitary structure.

4. Device according to claim 1, wherein said fan blade tip includes a plurality of components which can be separately detached from said fan blade.

5. Device according to claim 4 wherein each of two said prongs is separately detachable from said fan blade.

6. Device according to claim 1 wherein said fan blade tip is formed as a replaceable component of each of said plurality of fan blades.

7. A replaceable fan blade tip for attachment to a fan blade included on a fan wheel for transporting a web of material, said fan blade forming at least a portion of a fan pocket for receiving a sample of the web material, said fan blade tip comprising:

an attaching device for mounting the replaceable fan blade tip to the fan blade; and a receiving area having at least two prongs included within said fan blade tip for receiving a transport mechanism used to transport a product to said fan blade.

8. A replaceable fan blade tip according to claim 7, further comprising:

an aligning means for aligning the replaceable fan blade tip with the fan blade; and a fastening means for fastening the replaceable fan blade tip to the fan blade.

* * * * *